US007647697B2

(12) United States Patent
Yokouchi

(10) Patent No.: US 7,647,697 B2
(45) Date of Patent: Jan. 19, 2010

(54) METHOD OF MANUFACTURING NOZZLE PLATE, METHOD OF MANUFACTURING LIQUID EJECTION HEAD, AND MATRIX STRUCTURE FOR MANUFACTURING NOZZLE PLATE

(75) Inventor: Tsutomu Yokouchi, Kanagawa (JP)

(73) Assignee: Fujifilm Corporation, Tokyo (JP)

( * ) Notice: Subject to any disclaimer, the term of this patent is extended or adjusted under 35 U.S.C. 154(b) by 508 days.

(21) Appl. No.: 11/510,586

(22) Filed: Aug. 28, 2006

(65) Prior Publication Data

US 2007/0046726 A1 Mar. 1, 2007

(30) Foreign Application Priority Data

Aug. 29, 2005 (JP) ..... 2005-247742

(51) Int. Cl.
*B41J 2/16* (2006.01)

(52) U.S. Cl. ..... 29/890.1; 29/25.35; 347/47; 347/44; 347/20; 347/320; 347/323; 216/27; 205/118; 205/122

(58) Field of Classification Search ..... 29/890.1, 29/25.35; 347/44, 47, 20, 320, 323, 45; 216/27
See application file for complete search history.

(56) References Cited

U.S. PATENT DOCUMENTS 5,649,346 A * 7/1997 Katsuumi et al. ..... 29/25.35
6,426,481 B1 * 7/2002 Koide et al. ..... 219/121.71

FOREIGN PATENT DOCUMENTS

JP 08132625 A 5/1996
JP 10016236 A 1/1998
JP 2000185406 A * 7/2000

* cited by examiner

*Primary Examiner*—Derris H Banks
*Assistant Examiner*—Dan D Le
(74) *Attorney, Agent, or Firm*—Birch, Stewart, Kolasch & Birch, LLP

(57) ABSTRACT

The method manufactures a nozzle plate, and comprises: a patterned resist formation step of forming a patterned resist on a flat surface of a matrix substrate, the patterned resist having a shape corresponding to a diameter of nozzle holes in a nozzle plate to be formed, the patterned resist having a thickness corresponding to a length of the nozzle holes; a nozzle length regulating member placement step of placing the nozzle length regulating member having a flat surface onto the patterned resist in such a manner that the flat surface of the nozzle length regulating member faces the flat surface of the matrix substrate across the patterned resist; and a nozzle plate formation step of forming the nozzle plate by plating with the patterned resist between the flat surface of the matrix substrate and the flat surface of the nozzle length regulating member.

9 Claims, 14 Drawing Sheets

METHOD OF MANUFACTURING NOZZLE PLATE, METHOD OF MANUFACTURING LIQUID EJECTION HEAD, AND MATRIX STRUCTURE FOR MANUFACTURING NOZZLE PLATE

BACKGROUND OF THE INVENTION

1. Field of the Invention

The present invention relates to a method of manufacturing a nozzle plate, a method of manufacturing a liquid ejection head including the nozzle plate, and a matrix structure for manufacturing the nozzle plate, and more particularly to a method of manufacturing a nozzle plate by plating, a method of manufacturing a liquid ejection head including the nozzle plate, and a matrix structure for manufacturing the nozzle plate.

2. Description of the Related Art

Methods are known for manufacturing a nozzle plate having a plurality of nozzle openings by plating. In general, a resist is patterned onto a substrate, and plating is carried out with this patterned resist (resist pattern).

Plating is generally carried out by electroforming (electroplating) which precipitates metal in a plating solution by means of externally applied electrical energy, or electroless plating which precipitates metal in a plating solution by means of a chemical reaction. The growth of the metal film is controlled by means of the current, in the case of electroforming, or by means of time in the case of electroless plating.

Japanese Patent Application Publication No. 8-132625 (and in particular, FIG. 1) discloses patterning of a resist and electroforming which is divided into two stages. More specifically, restrictor sections (nozzle apertures) are formed by electroforming with the first stage resist pattern, and flow channel sections (straight sections) connected to these restrictor sections are formed by electroforming with the second stage resist pattern.

Japanese Patent Application Publication No. 10-16236 (and in particular, FIGS. 4 to 11) discloses a method of manufacturing a nozzle plate (head base) having nozzle holes which each include cylindrically-shaped parallel sections and funnel-shaped curved sections into which ink is introduced. If the overall thickness of the nozzle plate is 100 μm, for example, then the length of the cylindrically-shaped parallel sections, which determine the size of the liquid droplets, is sufficiently small (10 μm to 15 μm). More specifically, the resist layer corresponding to the cylindrically-shaped parallel sections, which govern the ejection characteristics, is thin. After patterning this thin resist, electroforming is carried out, and the nozzle plate is thereby formed.

If the number of nozzles formed in the nozzle plate is increased in order to raise the speed of image forming, then the surface area of the nozzle plate increases, accordingly. On the other hand, in order to achieve high image quality, a high level of precision is required in the length of the nozzle holes (nozzle length) which governs the ejection characteristics.

If the nozzle plate is formed by electroforming, the growth of the metal film is generally controlled by the amount of current; however, there is a problem in that the nozzle plate formed by electroforming has poor uniformity in terms of the plate thickness. Hence, the length of the nozzles is uneven over the nozzle plate.

More specifically, as shown in FIG. 21, when electroforming is carried out with a patterned resist 71 on a substrate 70, there are variations in the growth of the metal film which forms a nozzle plate 501 on the substrate 70. In particular, if carrying out plating over a large surface area, it is difficult to maintain uniform growth of the metal film all over the substrate by controlling the amount of current.

In other words, when forming the nozzle plate 501 having the plurality of nozzle holes, it is difficult to maintain the precision of the nozzle length, and unevenness in the ejection amount may occur due to the unevenness in the nozzle length, thus leading to deterioration of image quality.

Since variations may occur in the nozzle length in this fashion, a step of polishing the nozzle plate is then necessary to achieve a uniform nozzle length, after the electroforming. However, if the polishing is carried out, there is a problem in that the shape of the edge sections of the nozzle holes is degraded, and eventually, the image quality deteriorates.

In the method disclosed in Japanese Patent Application Publication No. 8-132625, in both the restrictor sections (nozzle apertures) in the first stage and the flow channel sections (straight sections) in the second stage, the length is generally controlled by means of the amount of current in the electroforming process, and therefore uniformity over the nozzle plate is poor.

In Japanese Patent Application Publication No. 10-16236 also, compared to the overall thickness of the nozzle plate, the length of the cylindrical sections of the nozzle holes which governs the ejection characteristics is still generally controlled by the amount of current during the electroforming, regardless of the size of this length, and ultimately variations occur over the nozzle plate. Moreover, since the resist patterning of the first stage and the resist patterning of the second stage are separate steps, then it is difficult to align the positions of the two resist patterns. In other words, there is a problem in that the nozzle shapes lose axial symmetry. In general, a positional displacement of several micrometers or so may occur.

Furthermore, even in a case where a nozzle plate is manufactured by electroless plating, similar problems to those in a case of manufacturing by electroforming occur.

SUMMARY OF THE INVENTION

The present invention has been contrived in view of the aforementioned circumstances, an object thereof being to provide a method of manufacturing a nozzle plate, a method of manufacturing a liquid ejection head, and a matrix structure for manufacturing a nozzle plate, whereby the nozzle lengths can be made uniform over the nozzle plate in which the nozzle holes are formed, and hence good ejection characteristics can be achieved.

In order to attain the aforementioned object, the present invention is directed to a method of manufacturing a nozzle plate, the method comprising: a patterned resist formation step of forming a patterned resist on a flat surface of a matrix substrate, the patterned resist having a shape corresponding to a diameter of nozzle holes in a nozzle plate to be formed, the patterned resist having a thickness corresponding to a length of the nozzle holes; a nozzle length regulating member placement step of placing the nozzle length regulating member having a flat surface onto the patterned resist in such a manner that the flat surface of the nozzle length regulating member faces the flat surface of the matrix substrate across the patterned resist; and a nozzle plate formation step of forming the nozzle plate by plating with the patterned resist between the flat surface of the matrix substrate and the flat surface of the nozzle length regulating member.

According to the present invention, since the distance between the flat surface of the matrix substrate and the flat surface of the nozzle length regulating member is kept to a uniform distance, and since a nozzle plate is formed by plating between the flat surface of the matrix substrate and the flat surface of the nozzle length regulating member, then the nozzle lengths are uniform over the nozzle plate and therefore, the ejection characteristics are improved.

Preferably, the nozzle length regulating member has openings.

According to this aspect of the present invention, a plating solution can be circulated through the openings in the nozzle length regulating members during the plating process. Furthermore, projections can be formed readily in the nozzle plate, and by means of these projections in the nozzle plate, it is possible to reduce the damage caused to the nozzle holes by, for instance, a wiping blade that is used to wipe the nozzle plate.

Preferably, at least one of the nozzle length regulating member and the patterned resist is provided with an electrode for growing metal precipitated by the plating on at least sections corresponding to peripheral regions of the nozzle holes.

According to this aspect of the present invention, the metal is grown selectively in the peripheral regions of the nozzle holes, by means of the electrode for growing the metal, which is formed in the sections of the nozzle length regulating member and/or the patterned resist which correspond to the peripheral regions of the nozzle holes. Therefore, it is possible to prevent the occurrence of abnormalities, such as voids.

Alternatively, it is also preferable that the method further comprises, before the nozzle plate formation step, a catalyzation step of subjecting at least one of the nozzle length regulating member and the patterned resist to catalyzation for growing metal precipitated by the plating on at least sections corresponding to peripheral regions of the nozzle holes.

According to this aspect of the present invention, the metal is grown selectively in the peripheral regions of the nozzle holes, by means of the catalyzation for growing the metal, which is carried out in the sections of the nozzle length regulating member and/or the patterned resist which correspond to the peripheral regions of the nozzle holes. Therefore, it is possible to prevent the occurrence of abnormalities, such as voids.

Preferably, the method further comprises, before the nozzle length regulating member placement step, a spacer member placement step of placing a spacer member between the matrix substrate and the nozzle length regulating member, the spacer member having a thickness corresponding to the length of the nozzle holes.

According to this aspect of the present invention, it is possible to prevent the nozzle length regulating member from approaching or floating up from the matrix substrate, and hence the nozzle length can be made more reliably uniform, throughout the whole nozzle plate.

Preferably, the patterned resist formation step includes an exposure step of subjecting resist provided on the flat surface of the matrix substrate to one of exposure with divergent light, and exposure with parallel light irradiated in an oblique direction with respect to the flat surface of the matrix substrate.

According to this aspect of the present invention, since the nozzle holes are formed in a tapered shape, the ejection characteristics are improved.

In order to attain the aforementioned object, the present invention is also directed to a method of manufacturing a liquid ejection head which ejects liquid, the method comprising the step of: bonding the nozzle plate manufactured by the above-described method, to a structural body in which one of flow channels and liquid chambers connecting to the nozzle holes in the nozzle plate are formed.

In order to attain the aforementioned object, the present invention is also directed to a liquid ejection head formed by bonding the nozzle plate manufactured by the above-described method, to a structural body in which one of flow channels and liquid chambers connecting to the nozzle holes in the nozzle plate are formed.

In order to attain the aforementioned object, the present invention is also directed to a matrix structure for manufacturing a nozzle plate, the matrix structure comprising: a matrix substrate which has a flat surface; a patterned resist which is formed on the flat surface of the matrix substrate, the patterned resist having a shape corresponding to a diameter of nozzle holes in a nozzle plate to be formed through the matrix structure, the patterned resist having a thickness corresponding to a length of the nozzle holes; and a nozzle length regulating member which has a flat surface and is placed on the patterned resist in such a manner that the flat surface of the nozzle length regulating member faces the flat surface of the matrix substrate across the patterned resist.

According to the present invention, it is possible to achieve uniform nozzle lengths over the nozzle plate formed with the nozzle holes.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DETAILED DESCRIPTION OF THE PREFERRED EMBODIMENTS

Figure 1:
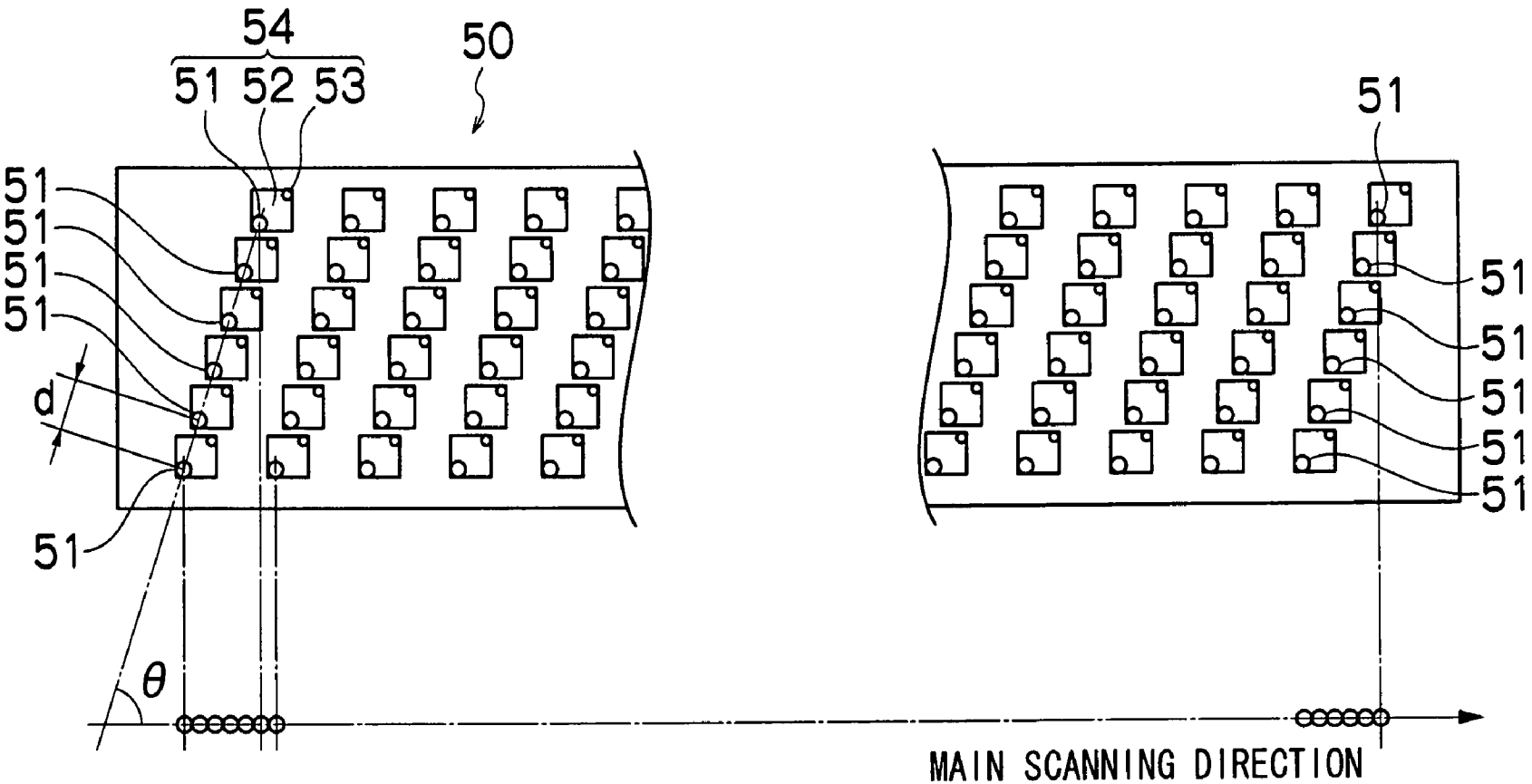
FIG. 1 is a plan view perspective diagram showing one embodiment of the overall structure of a liquid ejection head.

FIG. 1 is a plan view perspective diagram showing an approximate view of the general structure of a liquid ejection head according to an embodiment of the present invention.

In FIG. 1, the liquid ejection head 50 comprises a plurality of pressure chamber units 54 arranged in a two-dimensional configuration. Each of the pressure chamber units 54 has a nozzle hole (ejection port) 51, through which ink is ejected toward a recording medium, such as paper, a pressure chamber 52, connected to the nozzle hole 51, and an ink supply port 53 forming an opening through which the ink is supplied to the pressure chamber 52. In FIG. 1, in order to simplify the drawing, a portion of the pressure chamber units 54 is omitted from the drawing.

The plurality of nozzle holes 51 are arranged in the form of a two-dimensional matrix, following two directions: a main scanning direction (in the present embodiment, the direction substantially perpendicular to the conveyance direction of the recording medium); and an oblique direction forming a prescribed angle of θ with respect to the main scanning direction. More specifically, by arranging the plurality of nozzle holes 51 at a uniform pitch of d in the oblique direction forming the uniform angle of θ with respect to the main scanning direction, it is possible to treat the nozzle holes 51 as being equivalent to an arrangement of nozzles at a prescribed pitch (d×cos θ) in a straight line in the main scanning direction. According to this nozzle arrangement, for example, it is possible to achieve a composition which is substantially equivalent to a high-density nozzle arrangement which reaches 2400 nozzles per inch in the main scanning direction, for example. In other words, a high density is achieved for the effective nozzle pitch (projected nozzle pitch) obtained by projecting the nozzles to a straight line aligned with the lengthwise direction of the liquid ejection head 50 (main scanning direction). The nozzle arrangement following two directions as shown in FIG. 1 is called a two-dimensional matrix nozzle arrangement.

By means of the nozzle arrangement shown in FIG. 1, it is possible to compose a full line type liquid ejection head having a row of nozzles covering a length corresponding to the full width of the recording medium in the main scanning direction (the direction substantially perpendicular to the conveyance direction of the recording medium).

In implementing the present invention, the arrangement structure of the nozzle holes 51, and the like, is not limited in particular to the embodiment shown in FIG. 1. For example, it is also possible to compose a liquid ejection head having nozzle rows of a length corresponding to the full width of the recording medium, by joining together, in a staggered matrix arrangement, a number of short liquid ejection head blocks, in which a plurality of nozzle holes 51 are arranged two-dimensionally.

Figure 2:
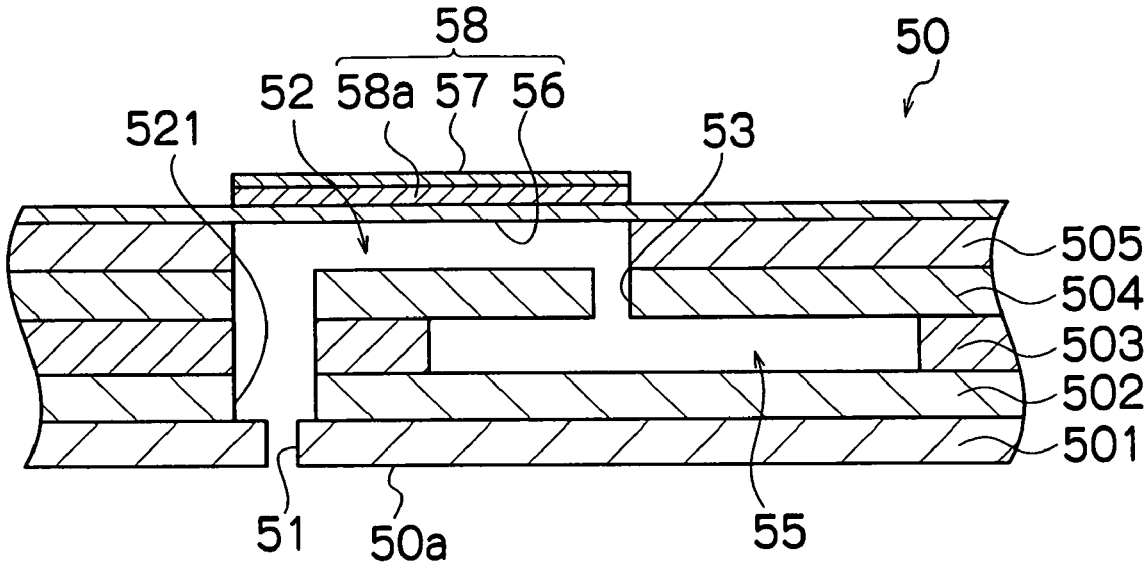
FIG. 2 is a cross-sectional diagram showing one embodiment of the internal structure of the liquid ejection head.

FIG. 2 is a cross-sectional diagram showing an embodiment of the internal structure of the liquid ejection head 50.

In FIG. 2, the liquid ejection head 50 includes: the nozzle hole 51, through which the ink is ejected; the pressure chamber 52 connected to the nozzle hole 51; an actuator 58, which forms a pressure generating device that applies pressure to the liquid in the pressure chamber 52 by changing the volume of the pressure chamber 52; and a common liquid chamber 55, which is connected to the pressure chamber 52.

The nozzle hole 51, the pressure chamber 52, and the ink supply port 53 of the pressure chamber 52 in FIG. 2 are the same as those shown in FIG. 1. In practice, the plurality of nozzle holes 51, the plurality of pressure chambers 52, and the plurality of actuators 58 are provided.

The liquid ejection head 50 has a laminated structure formed of: a nozzle plate 501, in which the nozzle holes 51 are formed; a nozzle connection plate 502, in which a portion of the nozzle flow channels 521 between the pressure chambers 52 to the nozzle holes 51 are formed; a common liquid chamber forming plate 503, in which the common liquid chamber 55 and a portion of the nozzle flow channels 521 are formed; an ink supply port forming plate 504, in which the ink supply ports 53 of the pressure chambers 52 and a portion of the nozzle flow channels 521 are formed; a pressure chamber forming plate 505, in which the pressure chambers 52 are formed; and a diaphragm 56, which constitutes the upper wall face (vibrating face) of the pressure chambers 52.

Piezoelectric bodies 58*a* are fixed on the diaphragm 56 on the side reverse to the side adjacent to the pressure chambers 52, and individual electrodes 57 are formed on the piezoelectric bodies 58*a*, so that each piezoelectric body 58*a* is arranged between the individual electrode 57 and the diaphragm 56, which also serves as a common electrode. The piezoelectric bodies 58*a* are made of lead zirconate titanate (PZT), for example, and they generate a displacement (distortion), when a prescribed electrical signal (drive signal) is applied to the corresponding individual electrodes 57, thereby changing the volume of the pressure chambers 52 through the diaphragm 56. Actuators 58 forming pressure generating devices are constituted by the diaphragm 56, the piezoelectric bodies 58*a* and the individual electrodes 57.

The diaphragm 56 according to the present embodiment is formed by one plate which is common for a plurality of pressure chambers 52, but it is not limited to a case of this kind, and may also be formed separately for each pressure chamber 52.

The common liquid chamber 55 collects ink which has been supplied from an ink tank (not shown) in an upstream position, and it supplies this ink to the pressure chambers 52 through the ink supply ports 53.

FIGS. 3A to 3E are illustrative diagrams used for describing a method of manufacturing the nozzle plate 501 according to the first embodiment.

Figure 3A:
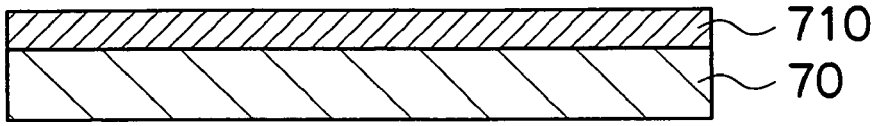
FIGS. 3A to 3E are illustrative diagrams used for describing one embodiment of a method of manufacturing a nozzle plate using a nozzle length regulating member.

Firstly, as shown in FIG. 3A, resist 710 is applied onto a flat upper surface of a matrix substrate 70 to a thickness corresponding to the length of the nozzle holes 51 to be formed, and the resist 710 is then patterned by exposure using a mask (not shown) and development.

Figure 3B:
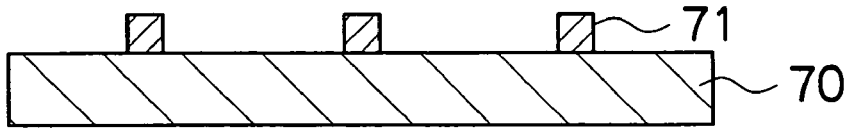

Thereby, as shown in FIG. 3B, a patterned resist 71 having a projecting shape, which corresponds to the diameter of the nozzle holes 51 to be formed and has the same thickness as the length of the nozzle holes 51, is formed on the matrix substrate 70.

Figure 3C:
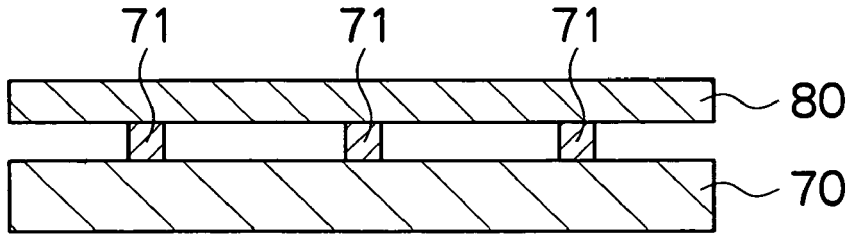

Thereupon, as shown in FIG. 3C, a plate-shaped nozzle length regulating member 80 having a flat lower surface is bonded onto the patterned resist 71. Here, the nozzle length regulating member 80 is arranged on the patterned resist 71 in such a manner that the flat surface (lower surface) of the nozzle length regulating member 80 faces the flat surface (upper surface) of the matrix substrate 70 across the patterned resist 71. The interval between the upper surface of the matrix substrate 70 and the lower surface of the nozzle length regulating member 80 is the same as the length of the nozzle holes 51 to be formed.

Figure 3D:
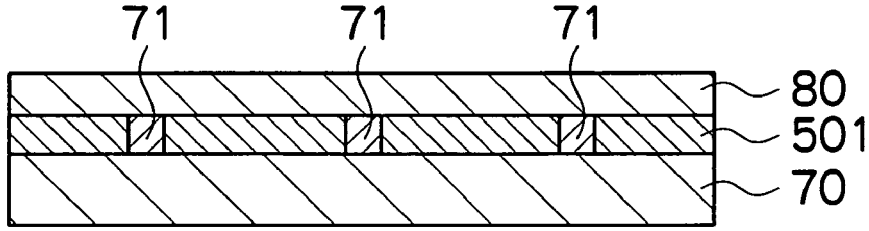

Thereupon, as shown in FIG. 3D, the nozzle plate 501 is formed by plating (either electroforming or electroless plating) between the upper surface of the matrix substrate 70 and the lower surface of the nozzle length regulating member 80.

If the nozzle plate 501 is formed by electroforming, then the matrix substrate 70 provided with an electrode layer on the upper surface thereof is used.

Figure 3E:
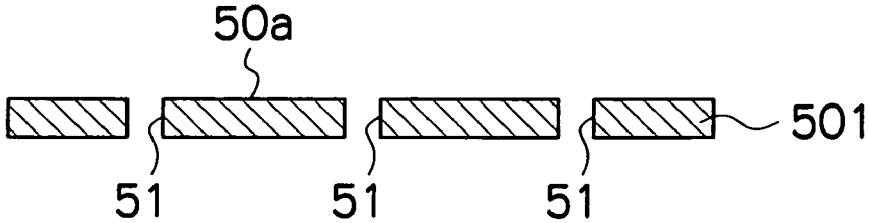

Thereupon, as shown in FIG. 3E, the nozzle plate 501 formed by plating is separated from the nozzle length regulating member 80, the patterned resist 71 and the matrix substrate 70.

For example, the nozzle plate 501 is formed to have an interval between the nozzle holes 51 (nozzle pitch) of 500 μm, a diameter of the nozzle holes 51 (nozzle diameter) of 20 μm, and a length of the nozzle holes 51 (nozzle length) of 20 μm.

The length of the nozzle holes 51 (nozzle length) is physically set to a uniform value by the nozzle length regulating member 80, and hence the uniformity of the nozzle length over the nozzle plate 501 is improved in comparison with a case where it is controlled by means of the amount of current or the time of the plating process as in the related art.

The accuracy of the nozzle length also depends on the accuracy of the thickness of the resist 710 applied to the matrix substrate 70. In general, whereas the unevenness of the thickness of the plating achieved by electroforming, or the like, is approximately ±10%, the unevenness of the thickness of the resist 710 is ±5% or less and is hence negligible.

Furthermore, since the plating is carried out in a state where the nozzle length regulating member 80 is mounted on the patterned resist 71, then it is possible to prevent the nozzle holes 51 from becoming sealed off by abnormal growth of metal film.

A sheet made of resin, such as polyimide, or a metal plate-shaped member is used for the nozzle length regulating member 80.

The bonding between the nozzle length regulating member 80 and the patterned resist 71 is carried out by using an adhesive, for example. There is another method of bonding in which the nozzle length regulating member 80 is pressed against the patterned resist 71, without adhesive.

Figure 4A:
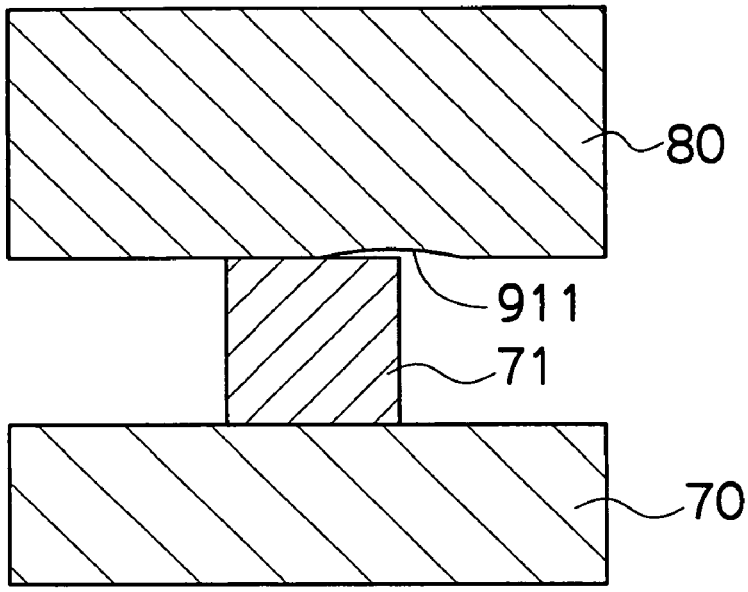
FIGS. 4A to 4C are illustrative diagrams used for describing the occurrence and removal of a burr.
Figure 4B:
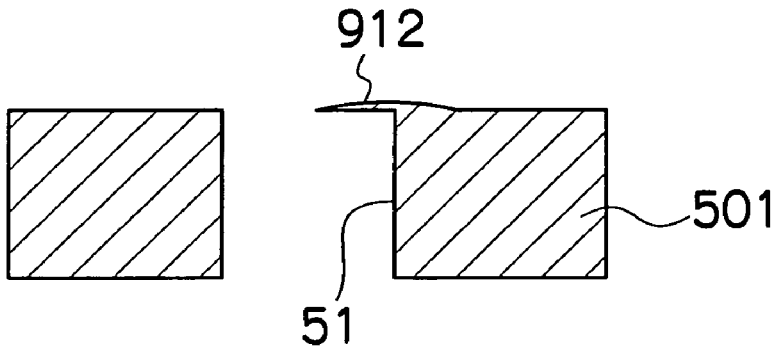
Figure 4C:
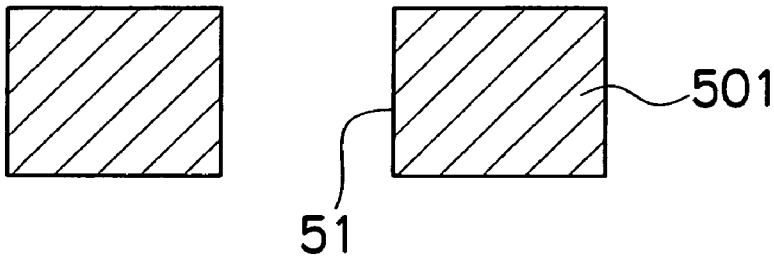

If the adhesion between the nozzle length regulating member 80 and the patterned resist 71 is not satisfactory, then as shown in FIG. 4A, a gap 911 is left between the nozzle length regulating member 80 and the patterned resist 71. Accordingly, as shown in FIG. 4B, a burr 912 occurs in the nozzle hole 51 of the nozzle plate 501 due to the precipitated metal growing into the gap 911. In cases of this kind, after forming the nozzle plate 501, the burr 912 is removed by electrolytic polishing, or the like, thereby obtaining the nozzle plate 501 that is free of burr, as shown in FIG. 4C. Since only a small component grows into the gap 911 between the nozzle length regulating member 80 and the patterned resist 71, it is possible to remove the burr 912 without affecting the diameter of the nozzle 51.

Figure 5:
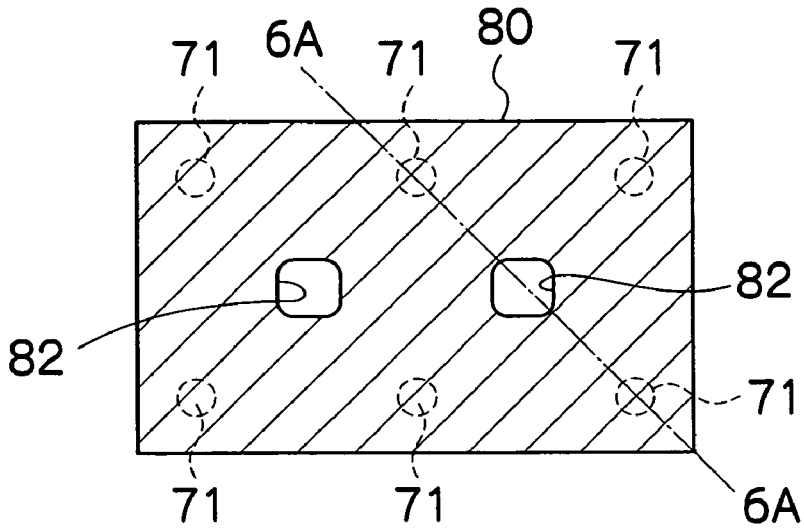
FIG. 5 is a plan diagram showing one embodiment of a nozzle length regulating member having openings.
Figure 6A:
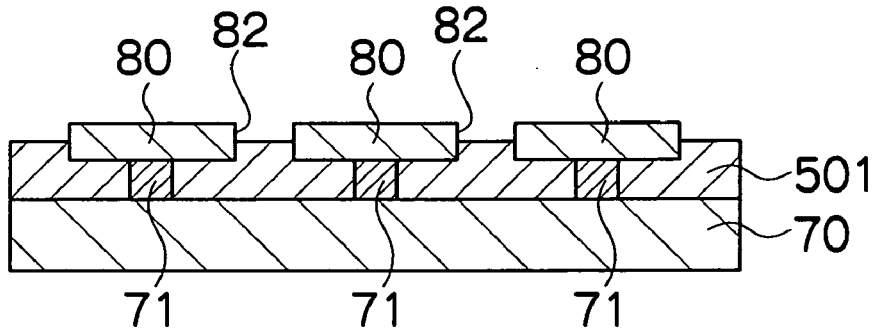
FIGS. 6A and 6B are illustrative diagrams used for describing one embodiment of a method of manufacturing a nozzle plate using a nozzle length regulating member having openings.

FIG. 5 is a plan diagram showing an embodiment of the nozzle length regulating member 80 having openings 82, and FIG. 6A shows a cross-sectional view along line 6A-6A in FIG. 5. A method of manufacturing a nozzle plate according to the second embodiment using the nozzle length regulating member 80 having the openings 82 is described with reference to FIGS. 6A and 6B.

The nozzle plate 501 is formed by plating between the matrix substrate 70 and the nozzle length regulating member 80 as shown in FIG. 6A, in a state where the nozzle length regulating member 80 having the openings 82 shown in FIG. 5 is bonded on the patterned resist 71.

In this plating process, a fresh plating solution can be circulated readily through the openings 82 formed in the nozzle length regulating member 80, and hence the precipitated metal is grown smoothly.

Furthermore, as shown in FIG. 6A, by growing metal so as to enter inside the openings 82, projections 5012 (see FIG. 6B) are formed in the nozzle surface 50*a* of the nozzle plate 501.

Figure 6B:
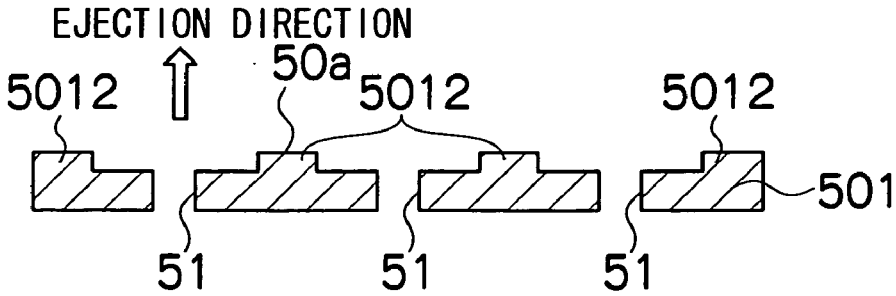

Thereupon, as shown in FIG. 6B, the nozzle plate 51 formed by plating is separated from the nozzle length regulating member 80, the patterned resist 71 and the matrix substrate 70.

The projections 5012 formed in the nozzle surface 50*a* protect the nozzle holes 51 when the nozzle surface 50*a* is wiped. More specifically, when the nozzle surface 50*a* is wiped by sliding a blade over the nozzle surface 50*a*, the projections 5012 have the role of reducing the damage caused to the nozzle holes 51 by the blade.

Similarly to the first embodiment, the nozzle lengths are uniform within the nozzle surface 50*a*. Here, the nozzle length is the length of the nozzle 51, and the nozzle length does not include the height of the projections 5012 formed in the nozzle plate 501 by the openings 82 of the nozzle length regulating member 80 in the present embodiment. In other words, the nozzle length is the same as the thickness of the nozzle plate 501 in the vicinity of the nozzle holes 51.

Figure 7A:
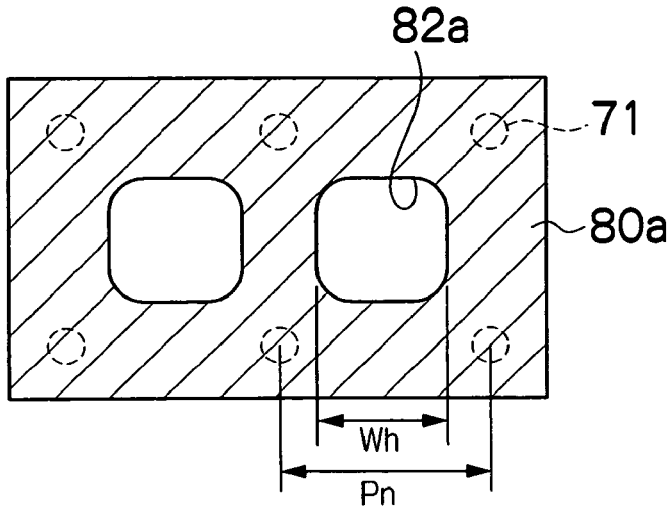
FIGS. 7A to 7C are plan diagrams showing embodiments of nozzle length regulating members having openings of typical shapes.
Figure 7B:
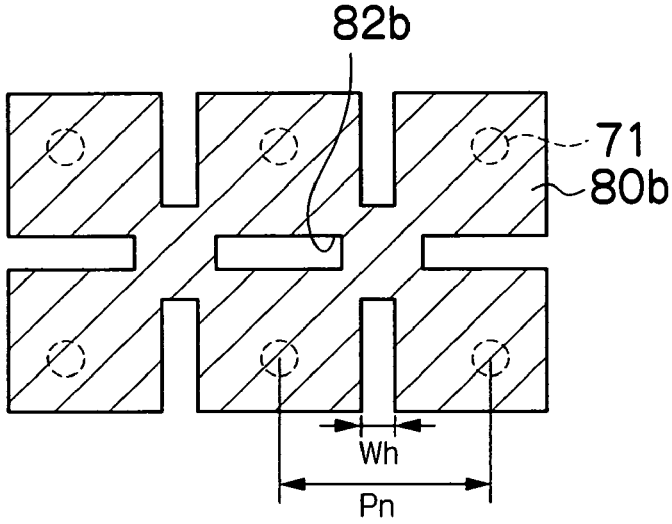
Figure 7C:
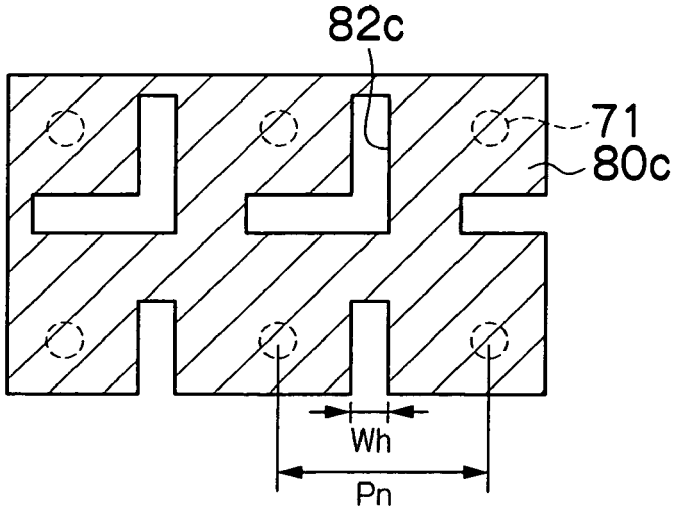

FIGS. 7A to 7C are plan diagrams showing typical embodiments of nozzle length regulating members having openings 82 of various types.

The nozzle length regulating member 80*a* in FIG. 7A is formed with openings 82*a* of large area, and it allows good circulation of the plating solution. More specifically, the width Wh of the opening 82*a* is greater than a half of the pitch Pn between the nozzle holes 51.

The nozzle length regulating member 80*b* in FIG. 7B and the nozzle length regulating member 80*c* in FIG. 7C are formed with narrow slit-shaped openings 82*b* and 82*c*, respectively, and have high rigidity in comparison with the nozzle length regulating member 80*a* in FIG. 7A. More specifically, the width Wh of the openings 82*b* and 82*c* is less than a half of the pitch Pn between the nozzle holes 51.

The shape of the openings is an optimal shape in terms of achieving a balance between rigidity of the nozzle length regulating member and protection of the nozzle holes 51 by the resulting projections 5012 during wiping.

The nozzle length regulating member 80*c* in FIG. 7C is formed with V-shaped openings 82*c* which span between the projections of the patterned resist 71 corresponding to the nozzle holes 51.

Figure 8:
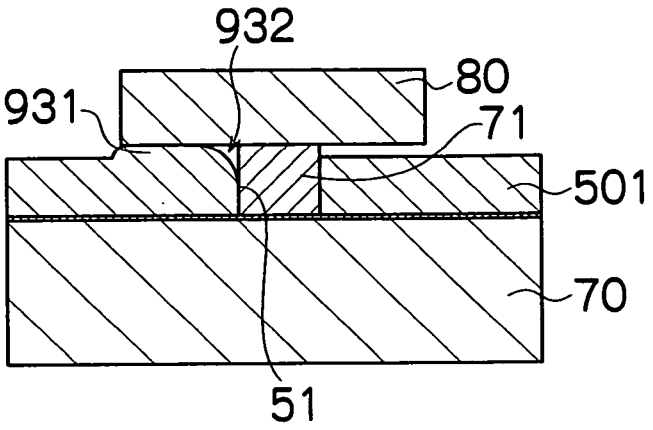
FIG. 8 is an illustrative diagram used for describing local abnormal growth in electroforming.

As shown in FIG. 8, there are also cases where, during the electroforming for creating a nozzle plate 501 on the matrix substrate 70, local abnormal growth sections 931 (bulges) and/or voids 932 (cavities) occur in the periphery (vicinity) of the nozzle holes 51, depending on the electroforming environment (for example, the instability of the supply of plating solution).

A method of manufacturing a nozzle plate according to a third embodiment for preventing the occurrence of local abnormal growth sections 931 and voids 932 is described with reference to FIGS. 9A and 9B.

Figure 9A:
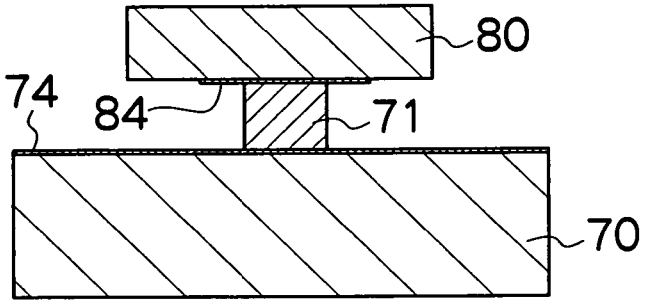
FIGS. 9A and 9B are illustrative diagrams used for describing one embodiment of a method of manufacturing a nozzle plate using electrodes for selective growth during electroforming.
Figure 9B:
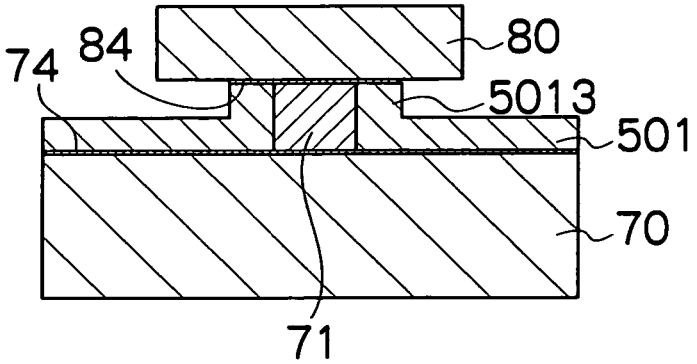

As shown in FIG. 9A, the nozzle length regulating member 80 is provided with electrodes 84 for inducing selective growing in electroforming. More specifically, the nozzle length regulating member 80 has the electrodes 84 for growing metal precipitated by electroforming, in positions corresponding to at least the periphery (vicinity) of the nozzle holes 51.

The nozzle length regulating member 80 is placed on top of the patterned resist 71 in such a manner that the electrodes 84 are in connection with the portions corresponding to the nozzle holes 51 (projections) in the patterned resist 71 on the matrix substrate 70. In this state, in other words, in a state where the electrodes 84 are arranged in at least the periphery of the projections of the patterned resist 71, a nozzle plate 501 is formed between the matrix substrate 70 and the nozzle length regulating member 80, by electroforming, on the basis of the patterned resist 71, as shown in FIG. 9B.

Accordingly, during the electroforming, a selective growth section 5013, where metal has selectively grown, arises due to the electrode 84 of the nozzle length regulating member 80, in each portion corresponding to the periphery (vicinity) of the nozzle hole 51 of the patterned resist 71. In other words, the occurrences of the local abnormal growth sections 931 and the voids 932 such as those shown in FIG. 8 are prevented.

The electroforming is carried out by setting the electrodes 84, which are formed on the flat surface of the nozzle length regulating member 80, to the same polarity as the electrode 74, which is formed on the flat surface of the matrix substrate 70.

FIGS. 10A to 10D are illustrative diagrams showing an embodiment of a process for manufacturing the nozzle length regulating member 80 having the electrodes 84 for forming the selective growth sections 5013.

Figure 10A:
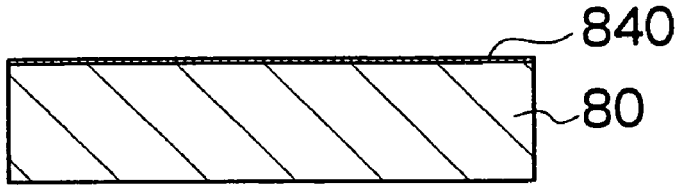
FIGS. 10A to 10D are illustrative diagrams used for describing one embodiment of a process for forming the electrodes on a nozzle length regulating member.

Firstly, as shown in FIG. 10A, a conductive layer 840 made of a metal film is formed by sputtering or vapor deposition over the whole upper surface of the nozzle length regulating member 80.

Figure 10B:
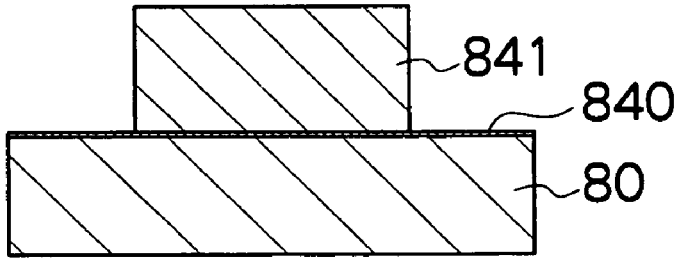

Thereupon, resist is applied onto the conductive layer 840 and is then patterned by exposure and development, thereby forming an electrode resist pattern 841 as shown in FIG. 10B.

Figure 10C:
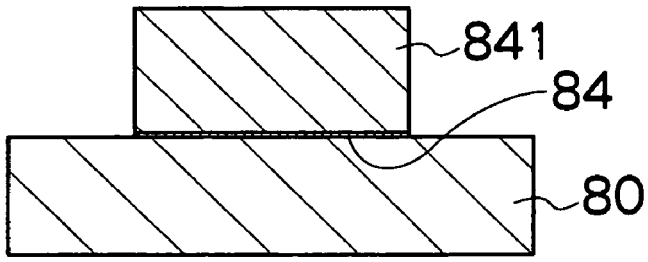
Figure 10D:
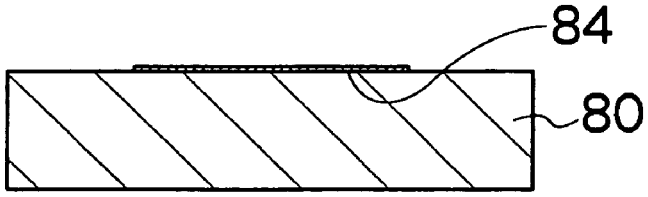

Next, as shown in FIG. 10C, the conductive layer 840 is patterned by etching, using the electrode resist pattern 841. Then, as shown in FIG. 10D, the electrode resist pattern 841 is removed, and the nozzle length regulating member 80 having the electrodes 84 corresponding to the nozzle holes 51 and the vicinity (periphery) thereof is formed.

The nozzle length regulating member 80 thus formed is inverted and placed on top of the patterned resist 71 on the matrix substrate 70 as shown in FIG. 9A. In this placement, the electrodes 84 of the nozzle length regulating member 80 are aligned in position with the projections of the patterned resist 71, which correspond to the nozzle holes 51.

Figure 11:
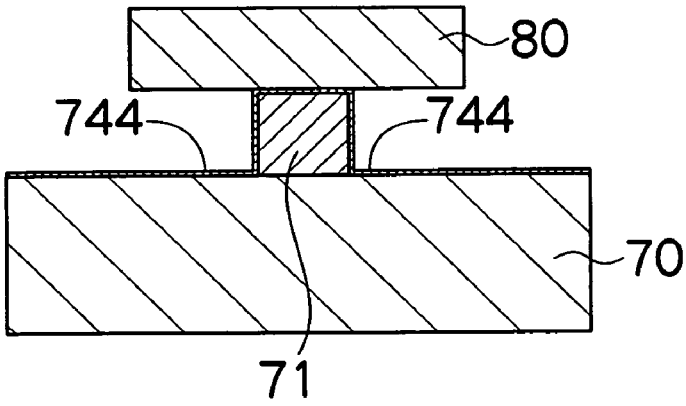
FIG. 11 is a cross-sectional diagram showing one embodiment of a matrix structure in a method of manufacturing a nozzle plate in which an electrode is formed over a patterned resist.

The foregoing description with reference to FIGS. 10A to 10D relates to a case where the electrodes 84 for forming the selective growth sections 5013 are provided on the nozzle length regulating member 80. Alternatively, as shown in FIG. 11, it is also possible to provide an electrode 744 for forming the selective growth sections 5013 over regions of the patterned resist 71 on the matrix substrate 70 that correspond to the nozzle holes 51 and the periphery (vicinity) of same.

Figure 12A:
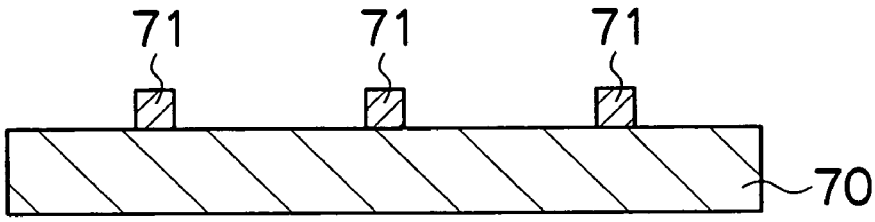
FIGS. 12A to 12C are illustrative diagrams used for describing one embodiment of a method of manufacturing a nozzle plate in which the electrode is formed over the patterned resist.
Figure 12B:
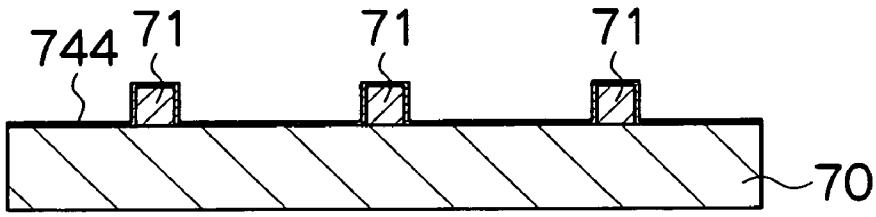
Figure 12C:
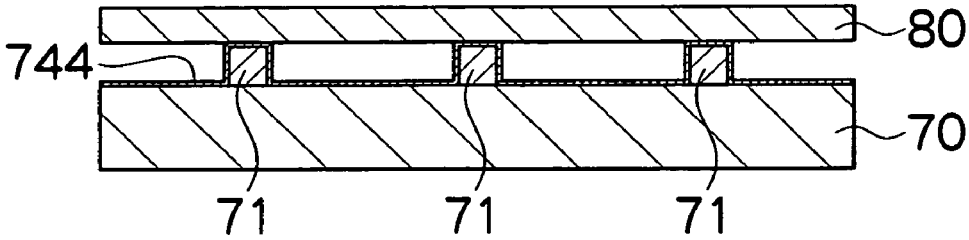

FIG. 12A to 12C are illustrative diagrams for describing an embodiment of a method of manufacturing a nozzle plate in which the electrode 744 is formed over the patterned resist 71 on the matrix substrate 70.

After forming the patterned resist 71 on the matrix substrate 70 as shown in FIG. 12A, a metal film forming the electrode 744 is deposited by sputtering or vapor deposition over the patterned resist 71 and the matrix substrate 70 as shown in FIG. 12B. After forming the electrode 744, the nozzle length regulating member 80 is placed on top of the patterned resist 71 on the matrix substrate 70 as shown in FIG. 12C.

According to the method that forms the electrode for selective growth on the patterned resist 71 in this way, positioning work becomes unnecessary and hence the process is simplified, in comparison with the method that forms the electrode for selective growth on the nozzle length regulating member 80 as described with reference to FIGS. 9A and 9B.

The case of forming the electrode for selective growth on the nozzle length regulating member 80 is described with reference to FIG. 9A to 10D, and the case of forming the electrode for selective growth on the patterned resist 71 is described with reference to FIGS. 11 to 12C. Moreover, it is also possible to form the electrodes for selective growth on both the nozzle length regulating member 80 and the patterned resist 71.

The foregoing description relates to the case where the nozzle plate 501 is formed by electroforming. Alternatively, if the nozzle plate 501 is formed by electroless plating, then a catalyzation step for creating selective growth of the metal to be precipitated by electroless plating is carried out in at least the regions of the nozzle length regulating member 80 and/or the patterned resist 71 that correspond to the periphery (vicinity) of the nozzle holes 51. Electroless plating is then performed after the catalyzation step.

Described in simple terms, the catalyzation step is a step in which the catalyst is deposited on the surface of the member to be plated before electroless plating. For example, a mixed solution of tin(II) chloride ($SnCl_2$), palladium chloride, and hydrochloric acid is used. The member to be plated is immersed in the mixed solution for 1 minute to 3 minutes at a temperature of 30° C. to 40° C., thereby precipitating palladium onto the surface.

There are various methods for depositing the catalyst selectively in the regions corresponding to the periphery of the nozzle holes 51. In the first method, the areas where the catalyst is avoided are masked, the member is then immersed in the mixed solution, and the mask is subsequently removed. In the second method, the mixed solution is applied only onto the sections where it is required, by using a dispenser. In the third method, the mixed solution is applied through screen printing. In the second and third methods, the process may be repeated if it is not possible to achieve sufficient deposition of the catalyst in a single operation.

Figure 13:
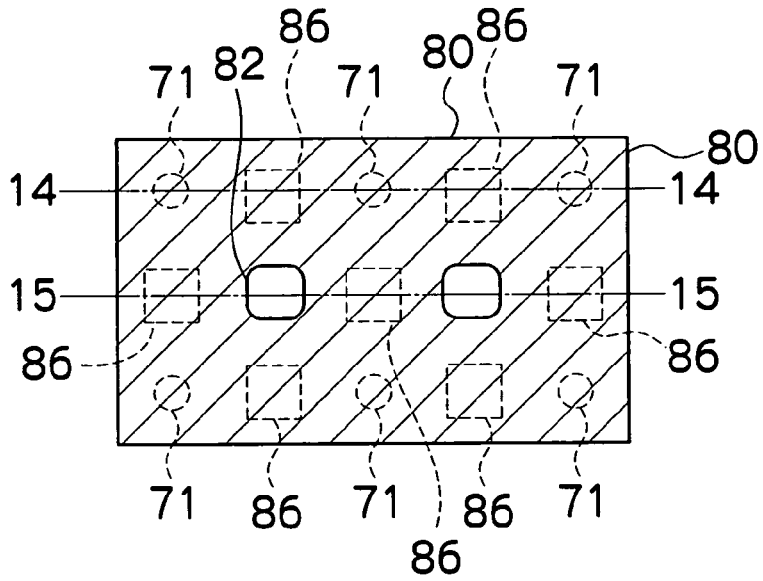
FIG. 13 is a plan diagram showing one embodiment of a matrix substrate in a method of manufacturing a nozzle plate using spacers.

FIG. 13 is a plan diagram showing one embodiment of a matrix structure in a method of manufacturing a nozzle plate using spacers 86. Furthermore, FIG. 14 shows a cross-sectional view along line 14-14 in FIG. 13; and FIG. 15 shows a cross-sectional view along line 15-15 in FIG. 13.

Figure 14:
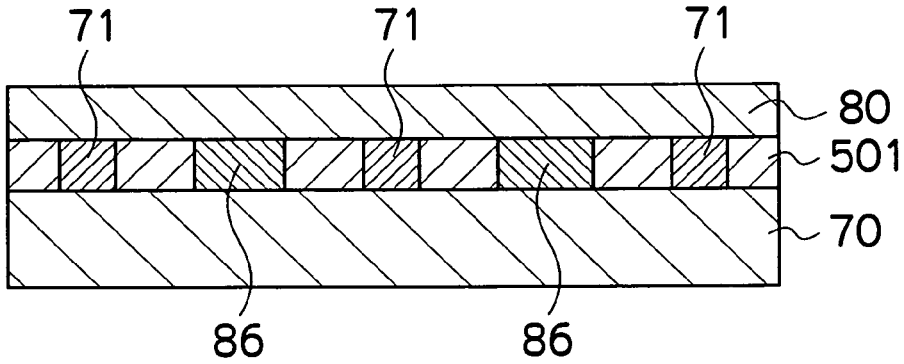
FIG. 14 is a cross-sectional diagram along line 14-14 in FIG. 13.
Figure 15:
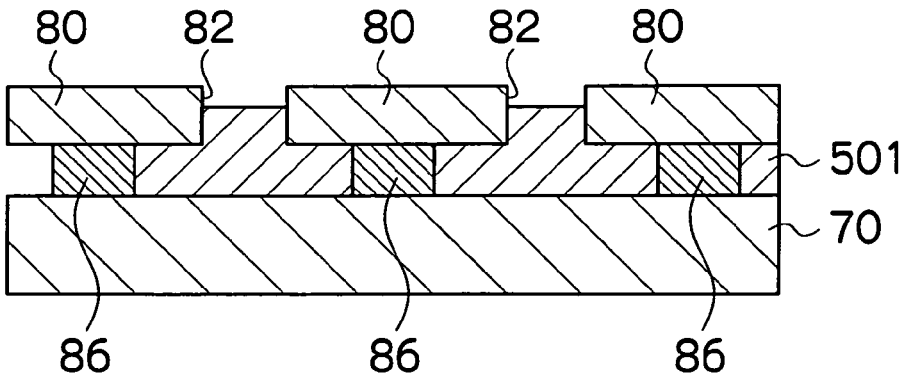
FIG. 15 is a cross-sectional diagram along line 15-15 in FIG. 13.

As shown in FIGS. 14 and 15, the spacers 86 having the same thickness as the length of the nozzle holes 51 to be formed (nozzle length) are arranged between the matrix substrate 70 and the nozzle length regulating member 80. In other words, the distance between the matrix substrate 70 and the nozzle length regulating member 80 is kept at a uniform value by the spacers 86 at positions between the nozzles 51, in addition to the patterned resist 71 corresponding to the nozzles 51. After positioning the spacers 86 in this way, the nozzle length regulating member 80 is placed on top of the patterned resist 71.

The spacers 86 prevent the nozzle length regulating member 80 from approaching the matrix substrate 70 or floating up above same, and thereby keep the distance between the matrix substrate 70 and the nozzle length regulating member 80 reliably to a uniform distance. Therefore, it is possible to reliably achieve a uniform nozzle length.

In an embodiment of a method of forming the spacers 86, the spacers 86 are formed simultaneously with the forming of the patterned resist 71 corresponding to the nozzle 51. In other words, by carrying out exposure and development after applying resist 710 to the matrix substrate 70 as shown in FIG. 3A, the spacers 86 are formed on top of the matrix substrate 70, in addition to the patterned resist 71 corresponding to the nozzle holes 51.

Alternatively, it is also possible to form the spacers 86 after forming the patterned resist 71.

For example, it is possible to use beads as spacers. These beads remain in the nozzle plate 501.

Moreover, it is also possible to form spacers 86 on the nozzle length regulating member 80.

If the nozzle plate 501 is formed in the state where the spacers 86 are arranged between the matrix substrate 70 and the nozzle length regulating member 80 as described above, then in general, openings are formed in the nozzle plate 501 at the positions having been occupied by the spacers 86. These openings serve as escape holes for the adhesive, when the nozzle plate 501 is bonded with the adhesive to the structure containing the flow channels.

Figure 16:
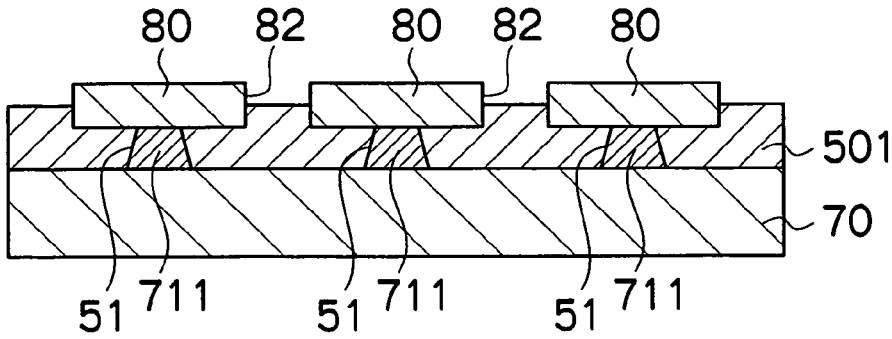
FIG. 16 is a cross-sectional diagram showing one embodiment of a matrix substrate in a method of manufacturing a nozzle plate having taper-shaped nozzles.

FIG. 16 is a cross-sectional diagram showing an embodiment of a matrix structure in a method of manufacturing a nozzle plate having taper-shaped nozzle holes.

In FIG. 16, constituent elements which are the same as the matrix structure shown in FIG. 6A are denoted with the same reference numerals, and since they have been described already, then further description thereof is omitted here.

In the present embodiment, a patterned resist 711 having taper-shaped projections is formed, as shown in FIG. 16. The nozzle plate 501 formed by plating on the basis of the patterned resist 711 has taper-shaped nozzle holes 51.

Figure 17A:
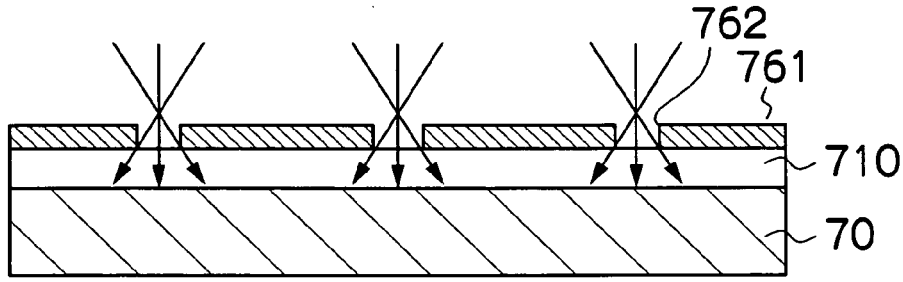
FIGS. 17A and 17B are illustrative diagrams used for describing one embodiment of a step of forming a patterned resist corresponding to taper-shaped nozzle holes.
Figure 17B:
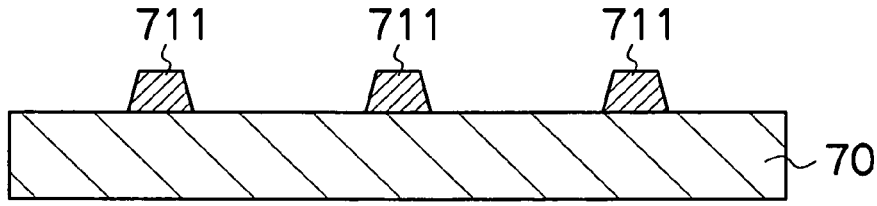

For example, as shown in FIG. 17A, the resist 710 is exposed to divergence light that diverges inside the resist 710 on the matrix substrate 70, through openings 762 in a mask 761. Accordingly, as shown in FIG. 17B, the patterned resist 711 having the taper-shaped projections is formed on the matrix substrate 70. Then, a metal film forming the electrode 744 is deposited by sputtering or vapor deposition over the patterned resist 711 and the matrix substrate 70 as shown in FIG. 18.

Figure 18:
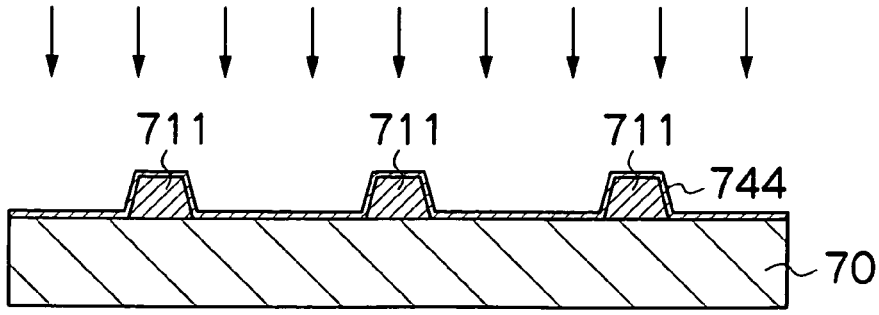
FIG. 18 is an illustrative diagram used for describing a step of forming an electrode over the patterned resist corresponding to taper-shaped nozzle holes.

By forming the projections of the patterned resist 711 in the tapered shape and forming the electrode 744 over the patterned resist 711 as shown in FIG. 18, the metal film can also be formed readily around the bases of the projections of the patterned resist 711, and hence the formation of the electrode 744 is facilitated.

Figure 19A:
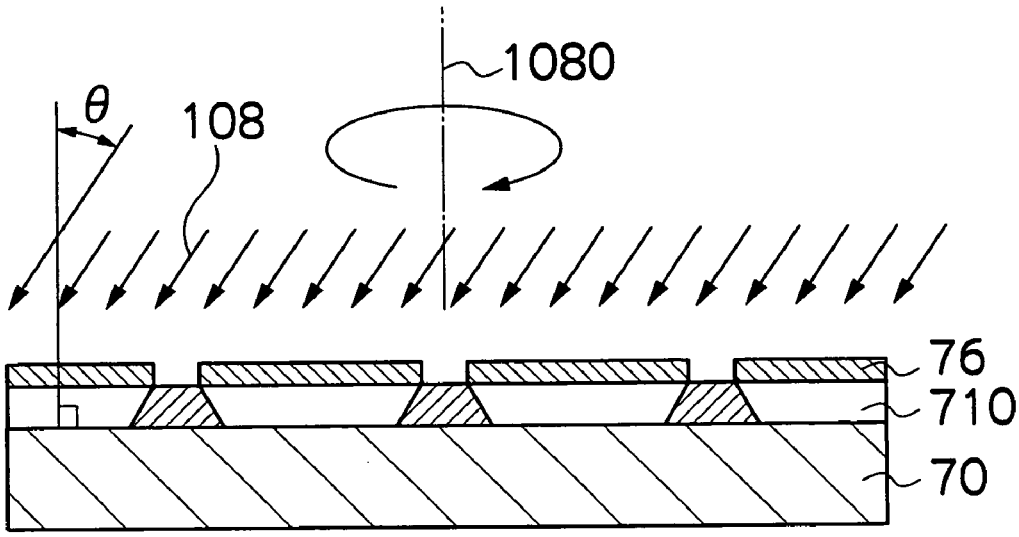
FIGS. 19A and 19B are illustrative diagrams showing embodiments of light exposure in an oblique direction.
Figure 19B:
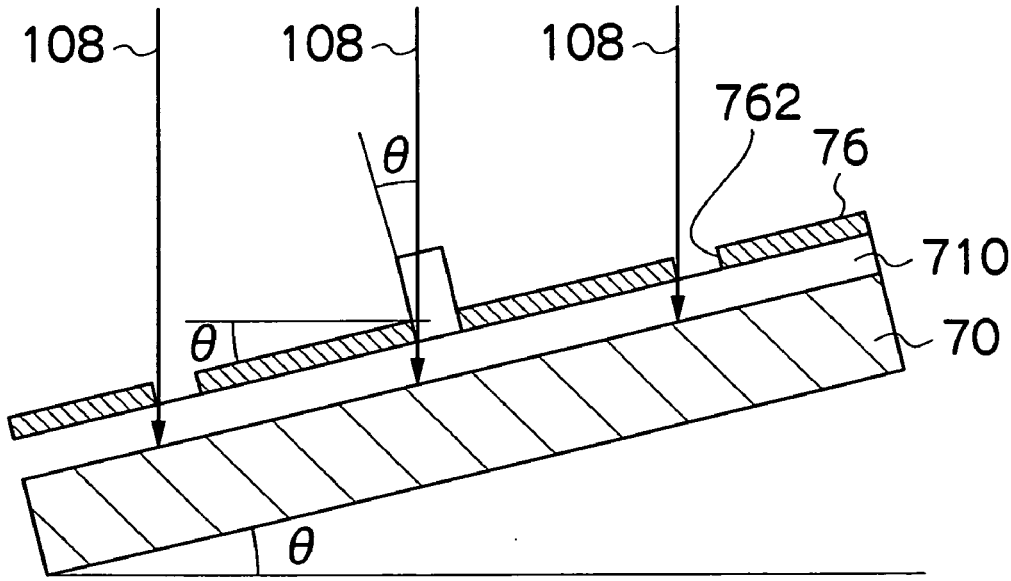

Furthermore, it is also possible to form the patterned resist 711 having the taper-shaped projections shown in FIG. 17B as follows. As shown in FIG. 19A, after applying resist 710 onto the matrix substrate 70, the resist 710 is subjected to exposure in which parallel light 108 is irradiated through a mask 76 from an oblique direction forming an angle of θ with respect to the normal of the surface of the matrix substrate 70 onto which the resist 710 has been applied, in other words, the parallel light 108 is irradiated while moving the optical axis in a precession movement about the rotational axis 1080 which is perpendicular to the surface of the matrix substrate 70, while maintaining an angle of incidence of θ. Alternatively, as shown in FIG. 19B, after applying resist 710 onto the matrix substrate 70, the resist 710 is exposed to the parallel light 108 at an angle of incidence of θ through a mask 76, while revolving the matrix substrate 70 in the state where the matrix substrate 70 is tilted to an angle of θ with respect to the horizontal direction.

Figure 20:
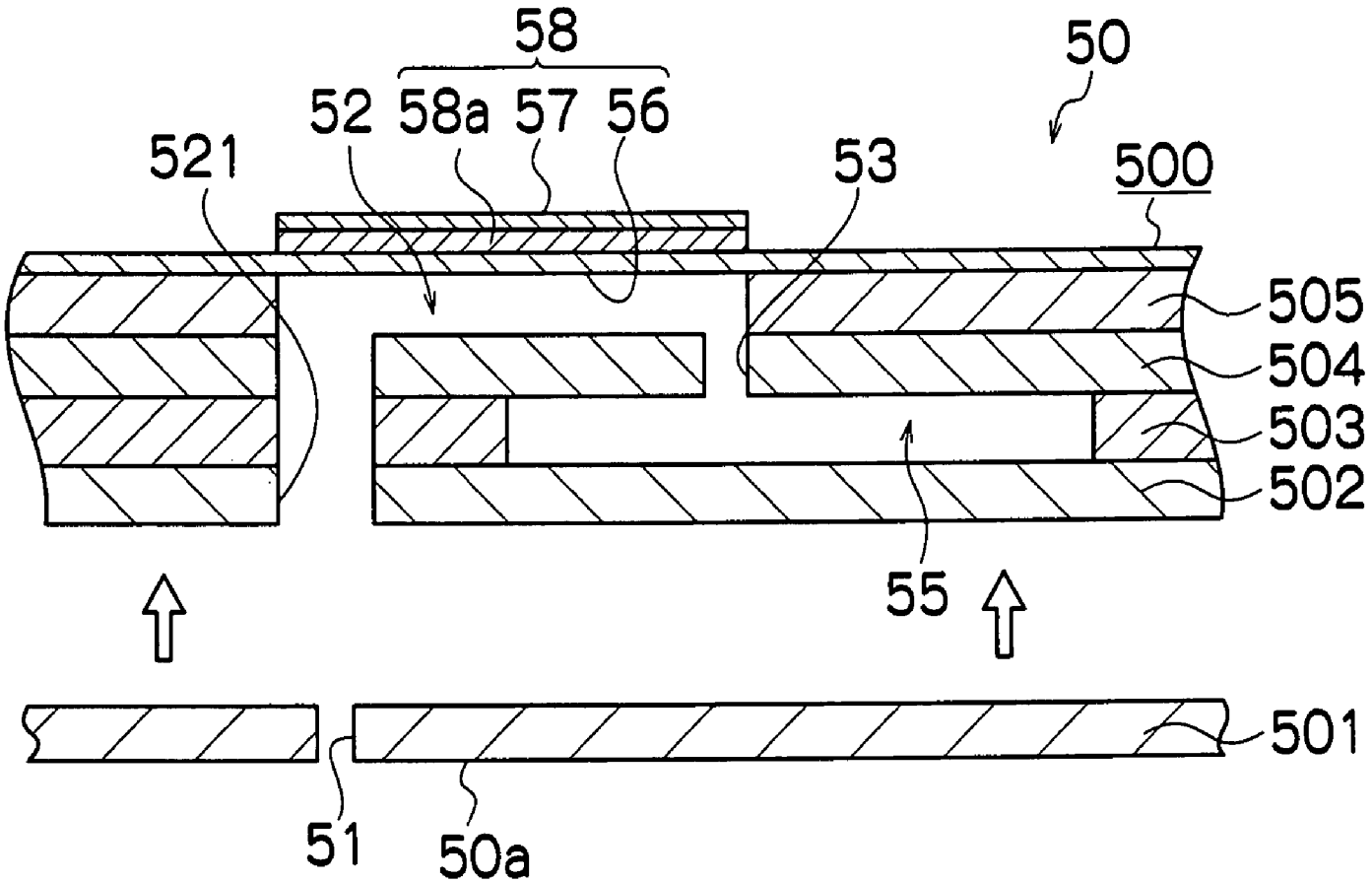
FIG. 20 is an illustrative diagram used for describing a step of bonding a nozzle plate, onto a structural body.
Figure 21:
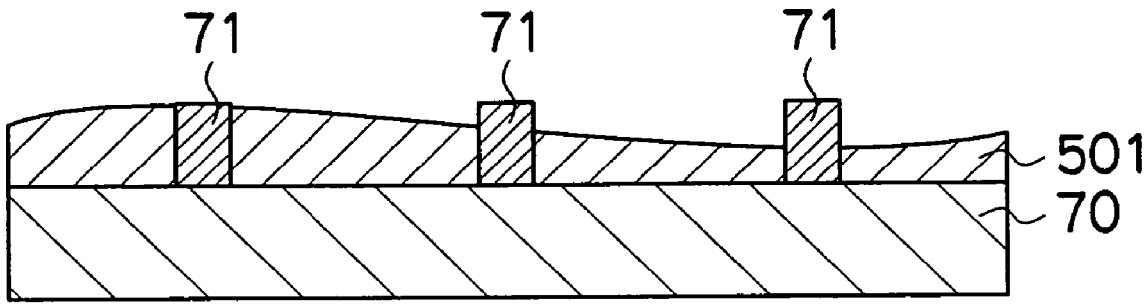
FIG.21 RELATED ART
FIG. 21 is an illustrative diagram used for describing variation in the nozzle lengths in a method of manufacturing a nozzle plate in the related art.

As shown in FIG. 20, the nozzle plate 501 thus manufactured is bonded to a structure 500 formed with the pressure chambers 52, the ink supply ports 53, the common flow channel 55, the diaphragm 56 (which also serves as the common electrode), the individual electrodes 57, the piezoelectric bodies 58*a*, and the like, thereby constituting the liquid ejection head 50 shown in FIGS. 1 and 2. In other words, the liquid ejection head is manufactured by bonding the nozzle plate 501 to the structure formed with the flow channels and/or the liquid chambers which connect to the plurality of nozzle holes 51 in the nozzle plate 501.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A method of manufacturing a nozzle plate, the method comprising:

a patterned resist formation step of forming a patterned resist on a flat surface of a matrix substrate, the patterned resist having a shape corresponding to a diameter of nozzle holes in a nozzle plate to be formed, the patterned resist having a thickness corresponding to a length of the nozzle holes;

a nozzle length regulating member placement step of placing the nozzle length regulating member having a flat surface onto the patterned resist in such a manner that the flat surface of the nozzle length regulating member faces the flat surface of the matrix substrate across the patterned resist; and a nozzle plate formation step of forming the nozzle plate by plating with the patterned resist between the flat surface of the matrix substrate and the flat surface of the nozzle length regulating member.

2. The method as defined in claim 1, wherein the nozzle length regulating member has openings.

3. The method as defined in claim 1, wherein at least one of the nozzle length regulating member and the patterned resist is provided with an electrode for growing metal precipitated by the plating on at least sections corresponding to peripheral regions of the nozzle holes.

4. The method as defined in claim 1, further comprising, before the nozzle plate formation step, a catalyzation step of subjecting at least one of the nozzle length regulating member and the patterned resist to catalyzation for growing metal precipitated by the plating on at least sections corresponding to peripheral regions of the nozzle holes.

5. The method as defined in claim 1, further comprising, before the nozzle length regulating member placement step, a spacer member placement step of placing a spacer member between the matrix substrate and the nozzle length regulating member, the spacer member having a thickness corresponding to the length of the nozzle holes.

6. The method as defined in claim 1, wherein the patterned resist formation step includes an exposure step of subjecting resist provided on the flat surface of the matrix substrate to one of exposure with divergent light, and exposure with parallel light irradiated in an oblique direction with respect to the flat surface of the matrix substrate.

7. A method of manufacturing a liquid ejection head which ejects liquid, the method comprising the step of:

bonding the nozzle plate manufactured by the method as defined in claim 1, to a structural body in which one of flow channels and liquid chambers connecting to the nozzle holes in the nozzle plate are formed.

8. A liquid ejection head formed by bonding the nozzle plate manufactured by the method as defined in claim 1, to a structural body in which one of flow channels and liquid chambers connecting to the nozzle holes in the nozzle plate are formed.

9. A matrix structure for manufacturing a nozzle plate, the matrix structure comprising:

a matrix substrate which has a flat surface;

a patterned resist which is formed on the flat surface of the matrix substrate, the patterned resist having a shape corresponding to a diameter of nozzle holes in a nozzle plate to be formed through the matrix structure, the patterned resist having a thickness corresponding to a length of the nozzle holes; and a nozzle length regulating member which has a flat surface and is placed on the patterned resist in such a manner that the flat surface of the nozzle length regulating member faces the flat surface of the matrix substrate across the patterned resist.

* * * * *